US005779079A

United States Patent [19]

Lee

[11] Patent Number: 5,779,079

[45] Date of Patent: Jul. 14, 1998

[54] MULTI-PURPOSE BEVERAGE CANISTER

[76] Inventor: Sang Chol Lee, 167-67, Seungsan-2 Dong, Mapo-Ku, Seoul, Rep. of Korea

[21] Appl. No.: 734,646

[22] Filed: Oct. 21, 1996

[51] Int. Cl.[6] ..... B65D 17/34

[52] U.S. Cl. ..... 220/4.07; 220/268; 220/677; 220/683

[58] Field of Search ..... 220/4.07, 268, 220/269, 270, 677, 678, 679, 680, 681, 683, 684

[56] References Cited

U.S. PATENT DOCUMENTS

| | | | |
|---|---|---|---|
| 1,961,117 | 5/1934 | Wall | 220/679 |
| 2,179,774 | 11/1939 | Zerbe | 220/679 |
| 3,024,934 | 3/1962 | Watter | 220/679 |
| 4,553,682 | 11/1985 | Tsurumaru et al. | 220/680 |
| 4,733,793 | 3/1988 | Moen | 220/270 |
| 4,923,084 | 5/1990 | Forbes | 220/270 |

*Primary Examiner*—Joseph M. Moy

*Attorney, Agent, or Firm*—Nikaido, Marmelstein, Murray & Oram LLP

[57] ABSTRACT

Disclosed is a multi-purpose beverage canister which can be split into upper and lower sections. The canister has an upper tab provided at an upper surface of the canister, a seal member which is attached at the upper surface of the canister and is opened by drawing the upper tab upwards, a take-off strip for binding upper and lower sections of the canister, and a lower tab fixed to the take-off strip. The canister is re-used as a cup, pencil case, and vessel, thereby not only reducing trash, but also preventing resources from wasting.

9 Claims, 5 Drawing Sheets

MULTI-PURPOSE BEVERAGE CANISTER

BACKGROUND OF THE INVENTION

1. Field of the Invention

The present invention relates to a beverage canister, and more particularly to a multi-purpose beverage canister which can be split into upper and lower sections in such a manner that it can be used as a cup or a pencil case.

2. Prior Arts

Generally, vessels used for containing a soft drink are divided into a plastic bottle, an aluminum canister, a paper pack and a glass bottle. These vessels are manufactured as disposable vessels so that they are used for once.

FIG. 1 shows a conventional aluminum canister 15. Conventional aluminum canister 15 has a tap 35 attached to an upper surface thereof, a seal member 25 which is opened as tap 35 is drawn upwards, and a welding portion 45. By opening seal member 25 of aluminum canister 15, a user can easily drink the soft drink contained therein.

However, although a separate-collection of wasting things is carried out, users usually throw away aluminum canister 15 into a garbage box carelessly just after they have drunk the soft drink contained therein, so the separate-collection of the empty canister may not be carried out well. Accordingly, not only is the disposition of the empty canister difficult, but also re-utilization rate of aluminum canister 15 lowers.

Since the aluminum canister is manufactured at a high cost, it is required to re-use the aluminum canister. Moreover, the aluminum canister contaminates soil if it is buried in soil, so the reclamation of the aluminum canister is desperately required to protect the environment.

SUMMARY OF THE INVENTION

The present invention has been made to overcome the above described problem of the prior art, and accordingly, it is an object of the present invention to provide a multi-purpose beverage canister which can be split into upper and lower sections in such a manner that it can be used as a cup or a pencil case.

To achieve the above object, the present invention provides a multi-purpose canister comprising, an upper tab provided at an upper surface of the canister; a seal member which is attached at the upper surface of the canister and is opened by drawing the upper tab upwards; a welding portion at which both ends of an aluminum plate are welded with each other so as to make a cylindrical shape; a take-off strip being attached to an outer wall of the canister, the take-off strip having a protrusion at its end, the take-off strip having at least one groove therein; and a lower tab fixed to the protrusion of the take-off strip.

Preferably, the groove is manufactured in such a manner that it can be prevented from an external impact. The canister is formed at its outer wall with a concave portion. The concave portion is positioned in correspondence to the lower tab so that the lower tab may be easily drawn.

Preferably, the canister has an inclined cutting portion at a circumference thereof. The inclined cutting portion splits the canister into upper and lower sections. The canister is provided at its outer wall with upper and lower hinge portions, a handle portion movably coupled to the upper and lower hinge portions, and a recess portion for receiving the handle portion.

According to another embodiment of the present invention, the upper hinge portion includes first and second upper hinges, the lower hinge portion includes first and second lower hinges, the handle portion includes a first handle coupled to first upper and lower hinges and a second handle coupled to second upper and lower hinges, and the recess portion includes first and second recesses for receiving the first and second handles, respectively.

Preferably, the seal member is formed integrally with a tip at an end thereof, and a slot is formed at the upper surface of the canister.

According to a preferred embodiment of the present invention, the canister includes a plastic bottle having the take-off strip as mentioned above.

DESCRIPTION OF THE PREFERRED EMBODIMENT

Hereinafter, the present invention will be described in detail with reference to the attached drawings.

Figure 1:
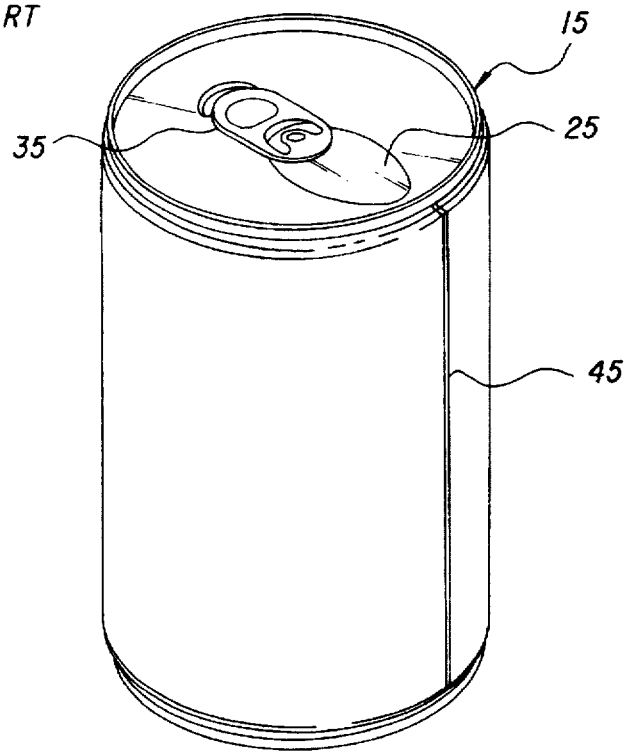
FIG.1 PRIOR ART
FIG. 1 is a perspective view of a conventional canister.
Figure 2:
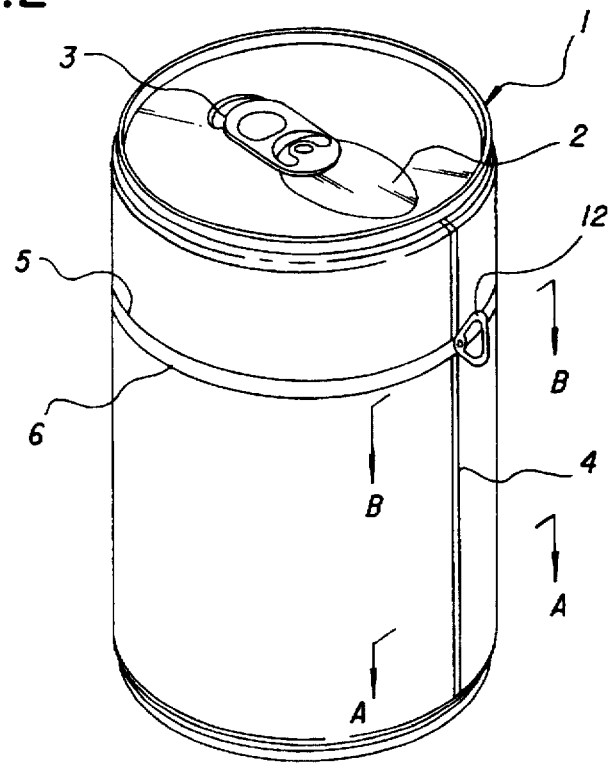
FIG. 2 is a perspective view of a canister according to the first embodiment of the present invention.

FIG. 2 shows a multi-purpose beverage canister 1 (hereinafter referred to canister) according to the first embodiment of the present invention. As shown in the FIG. 2, canister 1 has an upper tab 3 for opening a seal member 2 attached to an upper surface of canister 1, and a welding portion 4 at which both ends of an aluminum plate are welded with each other thereby making cylindrical canister 1.

A take-off strip 6 for binding upper and lower sections of canister 1 is transversely provided at an outer wall of canister 1. Take-off strip 6 has grooves 5 therein so that take-off strip 6 may easily separate from canister 1. In addition, take-off strip 6 is formed integrally at its end with a protrusion 10 which is securely fixed to a lower tab 12. As lower tab 12 is drawn, protrusion 10 is moved along lower tab 12 thereby separating take-off strip 6 from canister 1.

Figure 4:
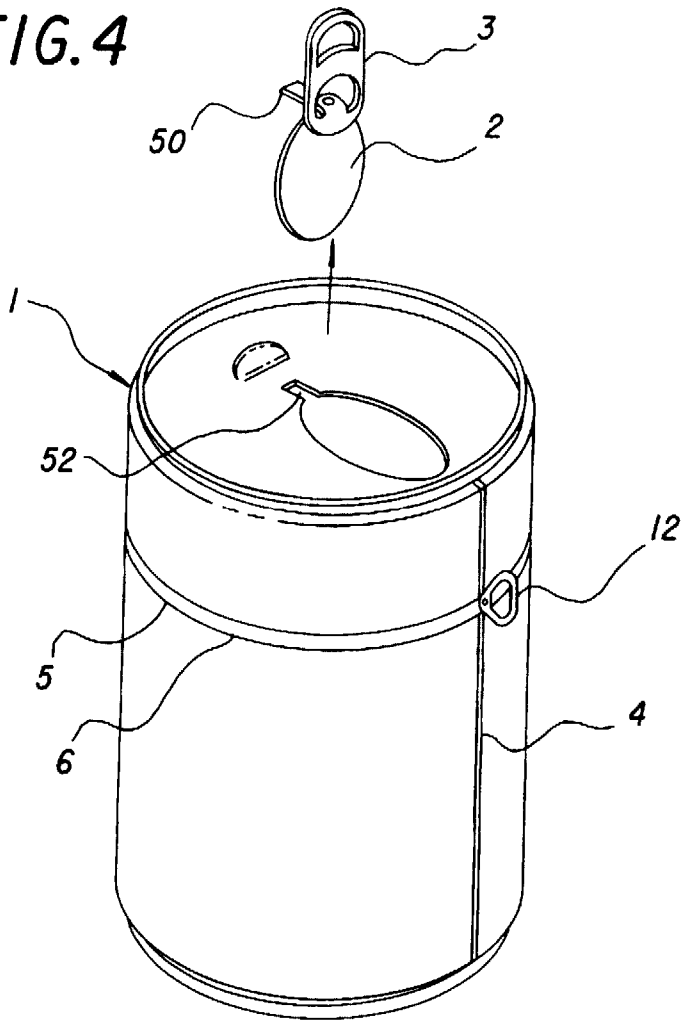
FIG. 4 is an exploded view of the canister shown in FIG. 2, in which the seal member is separated form the canister.
Figure 3:
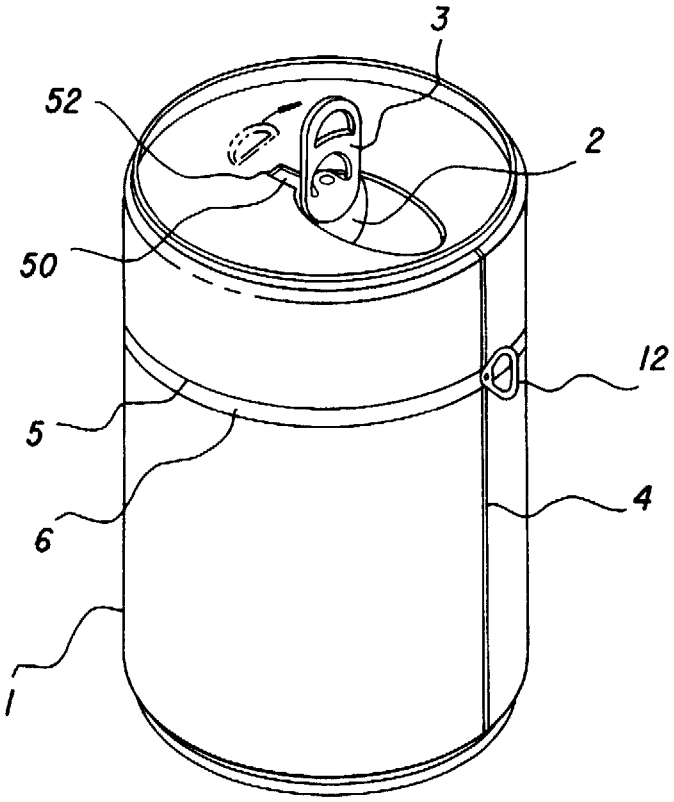
FIG. 3 is a perspective view of the canister shown in FIG. 2, in which a seal member is opened.
Figure 7:
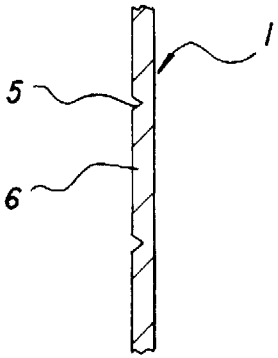
FIG. 7 is a sectional view showing a take-off strip having grooves.

Referring to FIG. 3, seal member 2 has a tip 50 engaged with a slot 52 formed at the upper surface of canister 1. Accordingly, as shown in FIG. 4 in detail, it is possible to use canister 1 as a saving box after drinking the soft drink contained in canister 1.

Figure 9:
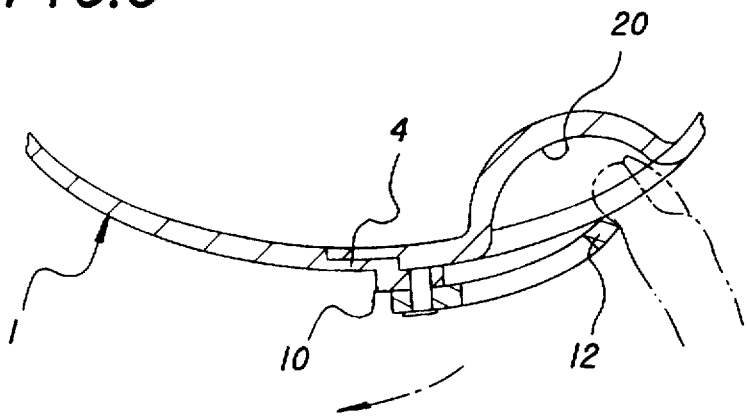
FIG. 9 is a partially sectional view of a canister according to the second embodiment of the present invention, in which a concave portion is formed at an outer wall of the canister such that a lower tab can be easily drawn.

FIG. 9 shows the second embodiment of the present invention. According to the second embodiment of the present invention, a concave portion 10 is formed at the outer wall of canister 1 such that lower tab 12 can be easily handled.

Figure 10:
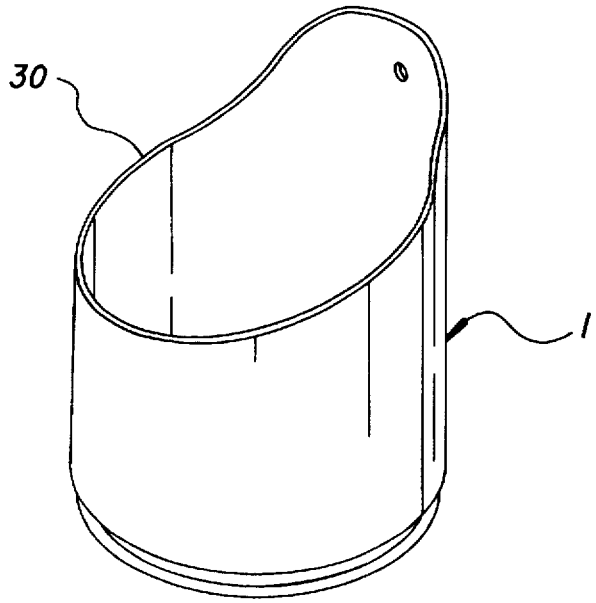
FIG. 10 is a perspective view of a canister used as a pencil case according to the third embodiment of the present invention.

FIG. 10 shows the third embodiment of the present invention in which canister 1 is used as a pencil case. In this embodiment, canister 1 is divided into upper and lower sections by an inclined cutting portion 30 to which take-off strip 6 is attached. When take-off strip 6 is separated from inclined cutting portion 30, the user can use the lower section of canister 1 as a multi-use vessel.

Figure 11:
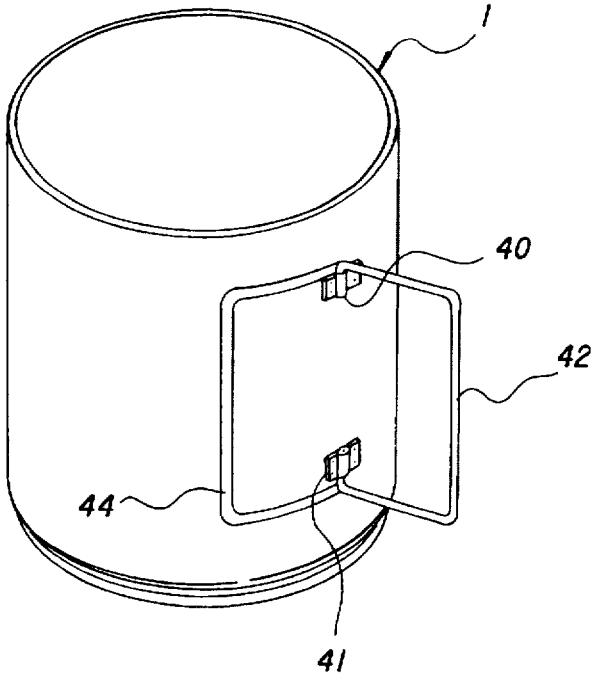
FIG. 11 is a perspective view of a canister used as a cup according to the fourth embodiment of the present invention, in which a handle is provided at an outer wall of the cup.

FIG. 11 shows the forth embodiment of the present invention. In this embodiment, canister 1 is provided at its outer wall with upper and lower hinges 40 and 41 to which a handle 42 is movably attached. In order to match handle 42 to the outer wall of canister 1, a recess having a shape in correspondence to handle 42 is formed at the outer wall of canister 1.

Figure 12:
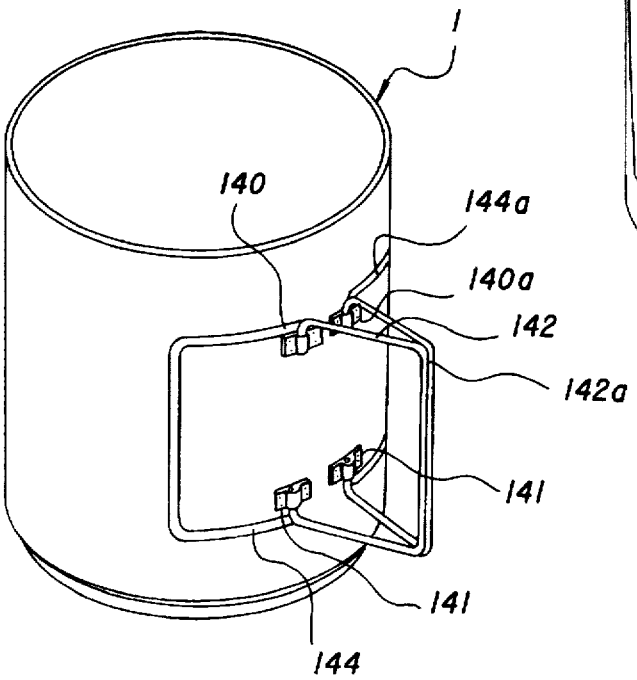
FIG. 12 is a perspective view of a canister used as a cup according to the fifth embodiment of the present invention, in which a pair of handles are provided at an outer wall of the cup.

FIG. 12 shows the fifth embodiment of the present invention. In this embodiment, canister 1 has first and second upper hinges 140 and 140*a*, and first and second lower hinges 141 and 141*a*. A first handle 142 is movably attached to canister 1 by first upper and lower hinges 140 and 141, and a second handle 142*a* is movably attached to canister 1 by second upper and lower hinges 140*a* and 141*a*. In order to match handles 142 and 142*a* to the outer wall of canister 1, a pair of recesses 144 and 144*a* having a shape in correspondence to handles 142 and 142*a* are respectively formed at the outer wall of canister 1.

Figure 13:
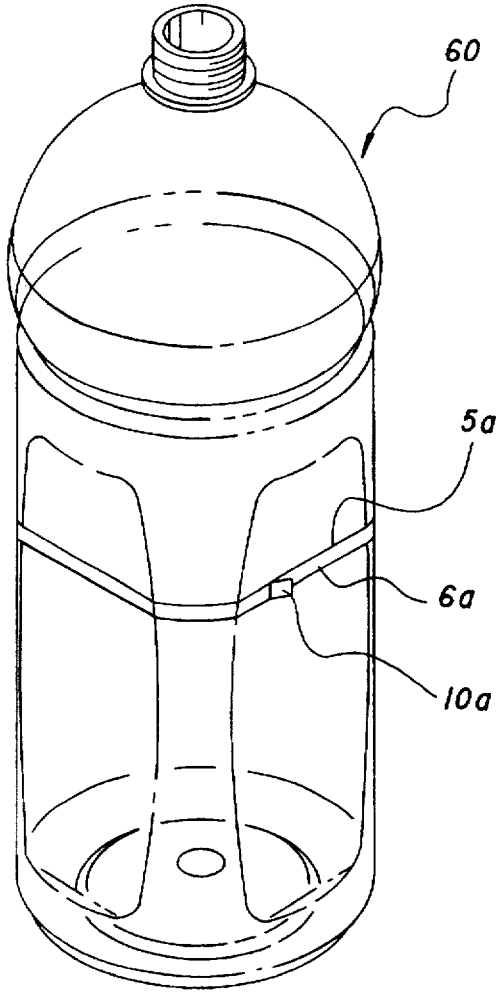
FIG. 13 is a perspective view showing a plastic bottle having a take-off strip according to the sixth embodiment of the present invention.

FIG. 13 shows the sixth embodiment of the present invention. In this embodiment, a take-off strip 6*a* having grooves 5*a* is transversely provided at an outer wall of a plastic bottle 60. Preferably, take-off strip 6*a* has a protrusion 10*a* at its end so that take-off strip 6*a* may easily separate from plastic bottle 60.

The present invention having the above described structures operates as follows.

Firstly, when the user wants to drink the soft drink contained in canister 1, the user draws upper tab 3 upwards. As a result, seal member 2 is opened as shown in FIG. 3. In this state, if the user lifts upper tab 3 upwards, tip 50 of seal member 2 is released from slot 52 so that the user can drink the soft drink contained in canister 1.

After that, the user draws lower tab 12 attached to the outer wall of canister 1. As a result, protrusion 10 fixed to lower tab 12 is also drawn together with lower tab 12 in the circumference direction of canister 1, so that take-off strip 6 formed integrally with protrusion 10 may separate from canister 1 thereby splitting canister 1 into upper and lower sections.

Figure 8:
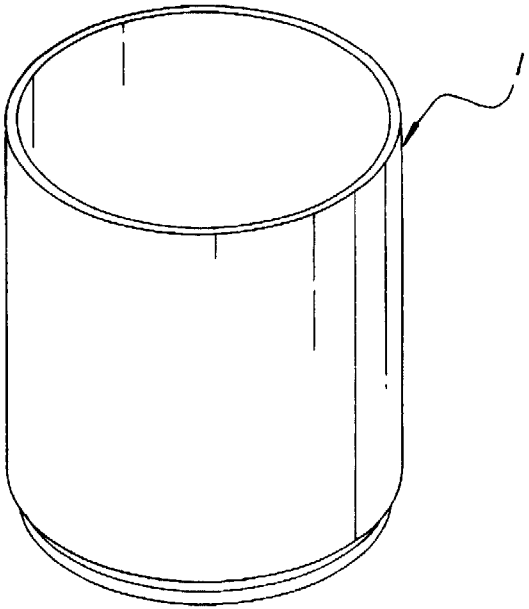
FIG. 8 is a perspective view showing a canister used as a cup.
Figure 5:
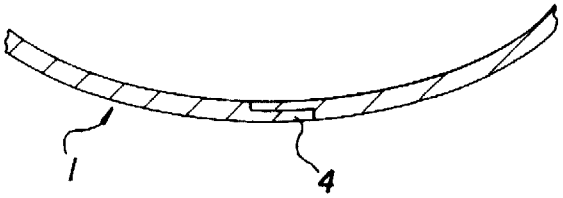
FIG. 5 is a sectional view taken along line A—A shown in FIG. 2.
Figure 6:
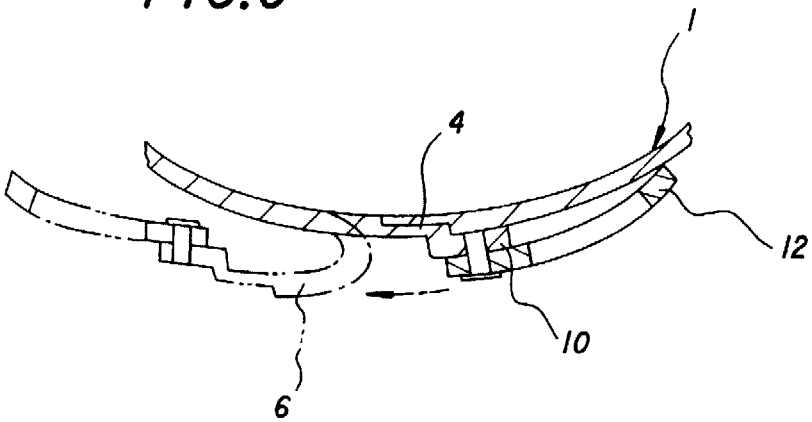
FIG. 6 is a sectional view taken along line B—B shown in FIG. 2.

At this time, take-off strip 6 is easily separated from canister 1 due to grooves 5 formed at take-off strip 6. When take-off strip 6 has separated from canister 1, the user can use the lower section of canister 1 as a cup as shown in FIG. 8.

In addition, according to the second embodiment of the present invention as shown in FIG. 9, canister 1 has concave portion 20 at the outer wall thereof so that lower tab 12 can be easily drawn.

According to the third embodiment of the present invention as shown in FIG. 10, canister 1 is provided at its circumference with inclined cutting portion 30 by which canister 1 is split into upper and lower sections and to which take-off strip 6 is attached, so that the user may use canister 1 as a multi-use vessel for receiving pencils or office supplies by detaching take-off strip 6 from inclined cutting portion 30.

In addition, according to the forth embodiment of the present invention as shown in FIG. 11, canister 1 has upper and lower hinges 40 and 41 to which a handle 42 is movably attached. When the user uses canister 1 as a cup, the user can take handle 42 by drawing handle 42 from recess 44, so the user may easily use the cup even when hot water is contained in the cup.

According to the fifth embodiment of the present invention, pairs of upper hinges 140 and 140*a*, lower hinges 141 and 141*a*, handles 142 and 142*a*, and recesses 144 and 144*a* are formed at the outer wall of canister 1. Therefore, by gripping handles 142 and 142*a*, the cup is not shaken in the left or right directions, so the user may stably use canister 1 as a cup.

In the meantime, when the user wants to use canister 1 as a saving box, the user takes away upper tab 3 from the upper surface of canister 1 as shown in FIG. 4. In this state, the user inserts coins into canister 1. Since slot 52 is formed at the upper surface of canister 1, the user can easily insert the coins into canister 1.

FIG. 13 shows the sixth embodiment of the present invention. As is understood from FIG. 13, if the user draws protrusion 10*a* in the circumference direction of canister 1, take-off strip 6*a* is easily separated from plastic bottle 60 due to grooves 5*a* formed in take-off strip 6*a*, so that the user may use plastic bottle 60 as a cup or office supplies.

As described above, the multi-purpose beverage canister of the present invention can be re-used as a cup, pencil case, vessel, or etc., thereby not only reducing trash, but also preventing resources from wasting.

While the present invention has been particularly shown and described with reference to the preferred embodiment thereof, it will be understood by those skilled in the art that various changes in form and detail may be effected therein without departing from the spirit and scope of the invention as defined by the appended claims.

What is claimed is:

1. A multi-purpose canister comprising:

an upper tab provided at an upper surface of the canister;

a seal member which is attached at the upper surface of the canister and is opened by drawing the upper tab upwards;

a welding portion at which both ends of an aluminum plate are welded with each other so as to make a cylindrical shape;

a take-off strip being attached to an outer wall of the canister, the take-off strip having a protrusion at its end and, the take-off strip having at least one groove therein; and a lower tab fixed to the protrusion of the take-off strip.

2. A multi-purpose canister as claimed in claim 1, wherein the canister is formed at its outer wall with a concave portion, the concave portion being positioned in correspondence to the lower tab so that the lower tab is easily drawn.

3. A multi-purpose canister as claimed in claim 1, wherein the canister has an inclined cutting portion at a circumference thereof, the inclined cutting portion splitting the canister into upper and lower sections.

4. A multi-purpose canister as claimed in claim 1, wherein the canister is provided at its outer wall with upper and lower hinge portions, a handle portion movably coupled to the upper and lower hinge portions, and a recess portion for receiving the handle portion.

5. A multi-purpose canister as claimed in claim 4, wherein the upper hinge portion includes first and second upper hinges, the lower hinge portion includes first and second lower hinges, the handle portion includes a first handle coupled to first upper and lower hinges and a second handle coupled to second upper and lower hinges, and the recess portion includes first and second recesses for receiving the first and second handles, respectively.

6. A multi-purpose canister as claimed in claim 1, wherein the seal member is formed integrally with a tip at an end thereof, and a slot is formed at the upper surface of the canister.

7. A multi-purpose canister as claimed in claim 1, wherein the canister includes a plastic bottle, the plastic bottle being provided at its outer wall with the take-off strip having the grooves and the protrusion.

8. A multi-purpose canister comprising:

an upper housing having a slot formed at the upper surface thereof;

a lower housing coupled to the upper housing, the lower housing being provided at its outer wall with upper and lower hinge portions, a handle portion movably coupled to the upper and lower hinge portions, and a recess portion for receiving the handle portion;

an upper tab provided at the upper surface of the upper housing;

a seal member which is attached at the upper surface of the upper housing and is opened by drawing the upper tab upwards, the seal member being formed integrally with a tip at an end thereof, the tip being engaged with the slot;

a welding portion at which both ends of an aluminum plate are welded with each other so as to make a cylindrical shape;

a take-off strip for binding the upper and lower housings of the canister, the take-off strip being attached to an outer wall of the canister, the take-off strip having a protrusion at its end, the outer wall of the canister being formed with a concave portion; and a lower tab fixed to the protrusion of the take-off strip, the lower tab being positioned in correspondence to the concave portion so that the lower tab is easily drawn.

9. A multi-purpose canister as claimed in claim 8, wherein the upper hinge portion includes first and second upper hinges, the lower hinge portion includes first and second lower hinges, the handle portion includes a first handle coupled to first upper and lower hinges and a second handle coupled to second upper and lower hinges, and the recess portion includes first and second recesses for receiving the first and second handles, respectively.

* * * * *